US006608565B1

(12) United States Patent
Van Steenwyk et al.

(10) Patent No.: US 6,608,565 B1
(45) Date of Patent: Aug. 19, 2003

(54) DOWNWARD COMMUNICATION IN A BOREHOLE THROUGH DRILL STRING ROTARY MODULATION

(75) Inventors: Donald H. Van Steenwyk, San Marino, CA (US); Robert M. Baker, The Woodlands, TX (US); Gary A. McBroom, The Woodlands, TX (US)

(73) Assignee: Scientific Drilling International, Houston, TX (US)

( * ) Notice: Subject to any disclaimer, the term of this patent is extended or adjusted under 35 U.S.C. 154(b) by 355 days.

(21) Appl. No.: 09/587,010

(22) Filed: Jun. 5, 2000

Related U.S. Application Data

(60) Provisional application No. 60/178,281, filed on Jan. 27, 2000.

(51) Int. Cl.[7] ..... G01V 1/16

(52) U.S. Cl. ..... 340/855.4; 367/82; 73/152.58; 175/195

(58) Field of Search ..... 340/855.4; 367/84, 367/82; 166/250.01, 104, 177.6, 177.1, 330, 332.2, 334.2; 73/152.58, 185, 187, 861.18; 175/195, 338, 415

(56) References Cited

U.S. PATENT DOCUMENTS 3,967,680 A * 7/1976 Jeter ..... 175/38
4,763,258 A * 8/1988 Engelder ..... 340/853.3
4,805,448 A * 2/1989 Armell ..... 73/152.53
5,464,058 A * 11/1995 McCoy et al. ..... 166/250.01
5,979,570 A * 11/1999 McLoughlin et al. ..... 175/24
6,092,610 A * 7/2000 Kosmala et al. ..... 175/61
6,267,185 B1 * 7/2001 Mougel et al. ..... 175/57

FOREIGN PATENT DOCUMENTS

GB 2352743 A 7/2001
WO WO 00/65198 11/2000

* cited by examiner

*Primary Examiner*—Michael Horabik
*Assistant Examiner*—Hung Dang
(74) *Attorney, Agent, or Firm*—William W. Haefliger

(57) ABSTRACT

A method for downward communication in a borehole containing a pipe string, comprising the steps of: imparting a series of rotary motions to an upper portion of the string, the rotary motions representing at least two levels of a coded data sequence, the rotary motions imparted to a string upper portion effecting generally comparable motions at a lower portion of the string; the motions at the string lower portion effecting a downhole detectable condition or conditions indicative of rotation or no-rotation; detecting the condition or conditions to determine a corresponding coded data sequence; and processing corresponding data sequence to recover the imparted coded data sequence, from which a unique transmitted message is determinable.

33 Claims, 8 Drawing Sheets

MUD PULSE
MWD TALK
DOWN MESSAGE
FORMAT

ANALOG SIGNAL CONDITIONING (BLOCK 105 OF FIG. 3)

DIGITAL SIGNAL PROCESSING (BLOCK 106 OF FIG. 3)

THRESHOLD DETECTION & MESSAGE CAPTURE STATE MACHINE
(BLOCK 107 FIG. 3)

SYNCH DETECTION
(BLOCK 107a)

MESSAGE CAPTURE AND DECODING (BLOCK 107b)

TALKDOWN
WAVEFORMS
&
TIMING

DOWNWARD COMMUNICATION IN A BOREHOLE THROUGH DRILL STRING ROTARY MODULATION

This application claims priority over provisional patent application Ser. No. 60/178,281 filed Jan. 27, 2000.

BACKGROUND OF THE INVENTION

This application claims priority over provisional patent application Serial No. 60/178,281 filed Jan. 27, 2000.

The purpose of this invention is to provide a means of transmitting instructions to downhole tools by means of drill string rotation encrypted commands. Mud-Pulse Measure-while-drilling (MWD) systems typically require a means of communicating to the tool during drilling operations to reconfigure the tool's operation. This is traditionally accomplished by transmitting an encoded message via cycling the mud pumps on and off at prescribed intervals.

In the past it has been common to instruct downhole tools to change modes of operation or perform or modify different functions by means of varying the flow of fluids being pumped down the drill string. Pressure switches or transducers that measure a differential pressure across the tool when fluids are flowing are used to sense this flow. The flow is stopped and started to send desired commands. Generally, such no-flow and flow states can be interpreted as the equivalent of a "0" or a "1" in a binary or binary-like code. Likewise, accelerometers that measure vibration can at times be used in place of pressure transducers because there are low level vibrations induced in a drill string and tools mounted in it when fluid flows.

This invention provides a method and apparatus for encrypting and receiving coded messages to downhole tools by measuring modulation of a downhole condition induced as by rotating the rotary table or turntable carrying the drill string at the surface of the earth which in turn rotates the drill string. This rotation is transmitted by the drill string to the downhole end of drill string and such rotation induces modulation of one or more downhole conditions that may be measured. Such downhole conditions may, for example, be linear or angular vibration levels, angular rate around the drill axis, directional tool face (relative direction of tool with respect to a true or magnetic North reference) or high-side tool face (relative rotation about the drill string with respect to gravity. This method has many advantages over the mud pump controlled (fluid flow controlled) messages as the rotary drive mechanisms can be more easily and more precisely controlled.

For instance, it is not uncommon to encrypt fluid flow messages with minutes of flow and no flow times where flow and no flow times might represent coded bits of a message. Measuring linear vibration induced from fluid flow is also now used to send messages to down hole tools, but this technique seriously loses sensitivity with large drill strings. Such methods still depend on modulation of the mud flow rate by starting and stopping the mud pumps. Measuring linear and/or angular vibration induced by rotating the drill string is far less sensitive to drill string size.

Downhole magnetic direction sensors are sometimes used to detect drill string rotation or the absence of drill string rotation and such information is used to command simple on-off functions for downhole tools. Such schemes detect that rotation is or is not occurring. Such schemes require non-magnetic drill string elements and have other complications as well Rotary tables can be easily controlled for 15-second periods of rotation-on and rotation-off. Thus, very expensive drill rig time can be saved. In addition, more complex encrypting concepts to even further shorten messages become possible because of the added precision possible with rotary drill string drive mechanisms (as opposed to the sluggish nature of controlling the large amounts of fluid needed to get adequate detection down hole).

One embodiment of this invention is based on the use of angular or linear vibration sensors to measure downhole vibration conditions and to use the resulting signals to decode messages transmitted to downhole tools by means of drill string rotation on-off-on at different levels for encrypting such messages. In other embodiments, an inertial angular rate sensor, typically a gyroscope, is used to sense commanded rotation angular rates of the drill string.

Accordingly, it is one major object of the invention to provide a method for downward communication in a borehole, comprising the steps:

a) imparting a series of rotary motions to an upper portion of the string, such rotary motions representing at least two levels of a coded data sequence, the rotary motions imparted to the string upper portion effecting generally comparable motions at or proximate the lower end of the drill string, or at a string lower portion, b) the rotary motions at or proximate the lower end of the drill string, or string lower portion, effecting a downhole detectable condition or conditions indicative of such imparted rotary motions, c) detecting said condition or conditions to determine a corresponding coded data sequence, d) and processing said corresponding data sequence to recover the imparted coded data sequence, from which a unique transmitted message is determinable.

More generally, the method for transmitting a message or information between upper and lower zones in a borehole includes the steps:

a) effecting rotary displacement of the pipe string at said upper zone in a manner to effect a corresponding rotary pipe displacement at said lower zone, b) said displacement representing at least two levels of a coded data sequence containing said message.

The method typically also includes providing an accelerometer detecting vibrational acceleration resulting from pipe string rotation, and having an output, there being sampling means responsive to the accelerometer output to sample at time intervals in excess of 50 times per second, there also being a filter to filter and average the output of the sampling means, and including the step of determining from the input of the filter whether pipe string rotation is occurring, and if such rotation is determined as occurring, then monitoring the output of the accelerometer to detect transitions above and below a threshold, for message determination.

Further objects include filtering and amplifying the downhole accelerometer output; repeatedly sampling that digitized output to produce a further output, and then subjecting that further output to progressive averaging to produce a progressively averaged output in the form of pulses; monitoring that progressively averaged output to determine whether it is continuously above a selected threshold for a predetermined time period, in which event, prospective message pulses are determined as being transmitted; and subjecting the determined prospective message pulses to pulse edge and pulse width discrimination, as a further determination of message validity.

These and other objects and advantages of the invention, as well as the details of an illustrative embodiment, will be more fully understood from the following specification and drawings, in which:

DRAWING DESCRIPTION

DETAILED DESCRIPTION

Figure 2:
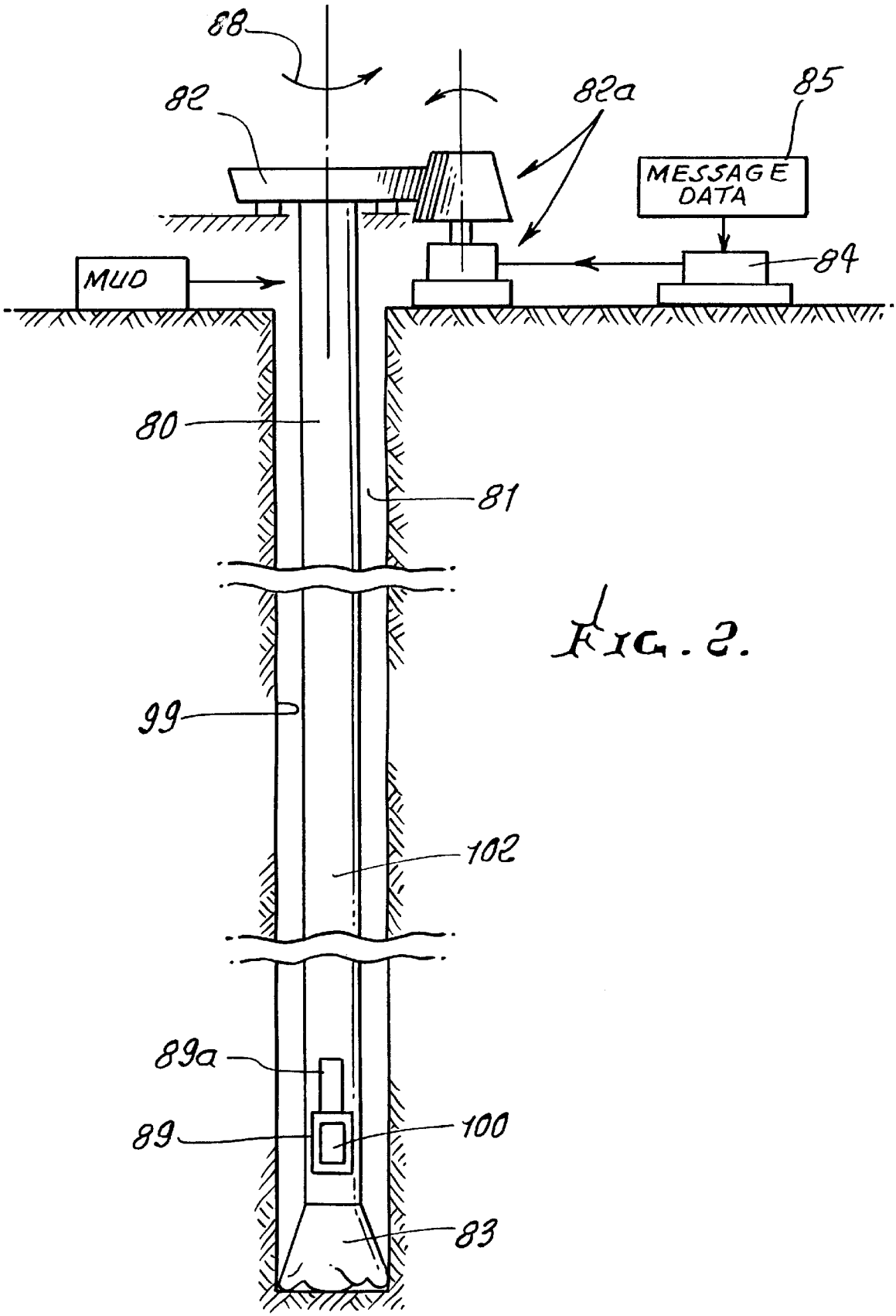
FIG. 2 is an elevation showing a borehole with elements of the invention illustrated at upper and lower pipe zones.

FIG. 2 shows a drill pipe string 80 in a well borehole 81. A rotary table 82 rotates the string, to rotate the bit 83, at the hole bottom for drilling. The drive 82*a* to the table is controlled at 84 to vary such rotation, as for example to input rotation to the table, to superimpose encrypted data (see message input 85) onto the table drilling drive, rotating the pipe in direction 88. The superimposed rotation causes vibration at the lower end of the drill string, which is detected and processed at 89, at the lower end of the string. A battery unit is shown at 89*a*, connected to 89. In one preferred embodiment the Mud Pulse MWD (measure while drilling) downhole communication system uses a linear accelerometer as at 100 in FIGS. 2 and 3 to detect the vibration of the tool 83 for example due to rotation of the drill string 102 in bore 99. The accelerometer circuitry at 89 responds to the low-level vibrations resulting from slow drill string rotation, as in direction of arrow 88.

Figure 3:
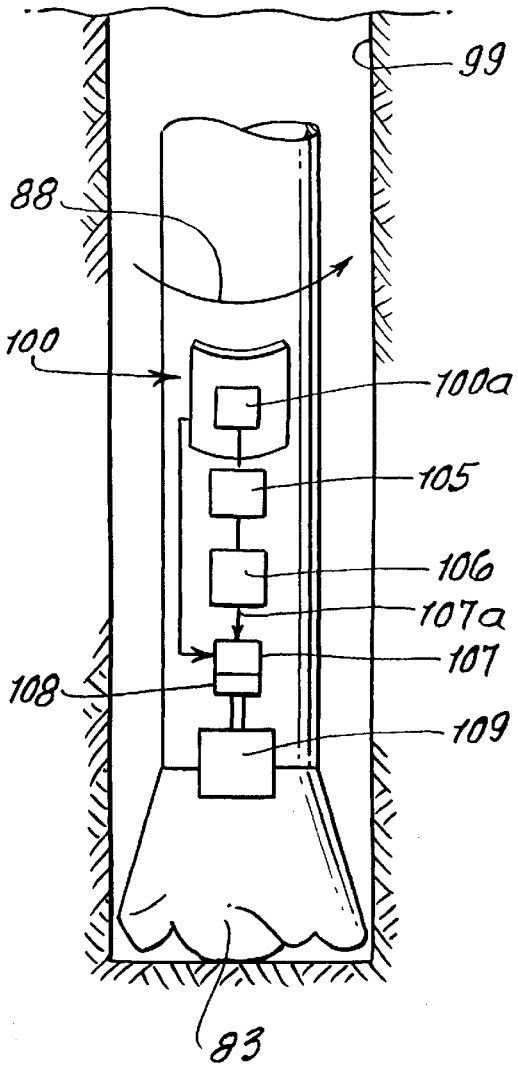
FIG. 3 is an elevation showing downhole equipment.

In a typical embodiment as seen in FIG. 3, the accelerometer output is conditioned and sampled 100 times per second as at circuitry 105 and passed through a non-weighted sliding-average filter 106, using 16 samples. If the averaged output is then detected as being continuously above a specified threshold for specified time, the tool comparator circuit 107 considers the vibration high enough to conclude that rotation is occurring. The tool circuitry then monitors the accelerometer output, as via circuitry 107 and input at 107*a*, checking for transitions below and above the threshold, or a continuous level above the threshold. The former state indicates a message is being sent from the surface while the latter indicates drilling operations are proceeding. The received message is used by actuator 108 to control a tool parameter, as for example opening and closing of a valve in device 109 (for example a mud flow control valve where mud drives a bit).

Message Format

One method for sending commands is to cycle the rotary table on and off at unique time intervals for the various messages being sent. A set of typical messages is shown in the timing diagram, FIG. 1,that illustrates the wave shapes for eight defined messages. A base pulse width, PW, is selected by the operator. A nominal pulse width, PW, is typically 20 seconds. If the accelerometer detects continuous vibration for a time equal to two pulse widths minus a 4-second tolerance period, the system will assume no talk down message is being received. Otherwise, the system will decode the unique talk down message being received. The tool then responds to the message and carries out the directed action as for example opening or closing a mud flow control valve. Note that in FIG. 1 there is the basic default message which just means to transmit the normal data that is ready for transmittal in the tool default mode. Seven alternative commands are shown in the figure. Thus seven different modes of operation of chosen sets of data may be transmitted in response to these commands. Also note the Synchronize message which permits proper decoding of the other seven messages.

Alternative Configurations

As one alternative to sensing the downhole linear vibration level resulting from angular rotation of upper end of the drill string, downhole angular vibration may be sensed. The sensor 100 may be considered as representing an angular vibration sensor.

Another alternative is that of direct rotation sensing. For this alternative, an inertial angular rate sensor such as a rate-sensitive gyroscope may be used to detect the angular rotation rate or the inertial angular acceleration or the rate of change of the inertial angular acceleration of the downhole tool location. Again, sensor 100 may be considered as representing a direct rotation sensor. General coding of messages for these alternatives could be identical to that shown in FIG. 1. The coding can be either one of rotation rate or no rotation rate, or it could be one of two or more discreet rotation rates $R_1$ and $R_2$ used as signal levels. For example, where $R_1$ is a drill pipe string rotation rate during drilling, $R_2$ can be larger or smaller than $R_1$, and a coded message can be transmitted, during drilling, i.e. without interrupting drilling. In this manner, a message to change the mode of operation of the downhole tool can be sent simply by coding the rotation rate of the drill string without having to stop the rotation of the drill string. One drill string drive means, generally well known by the term top drive is particularly suited to this variable angular rate signaling, because the rotation rate can be controlled very accurately.

Further, either of these alternative sensing approaches can be used together with the linear vibration-sensing approach shown previously as a means to provide a cross-check on the messages transmitted and provide a higher confidence in a transmitted message.

Figure 4:
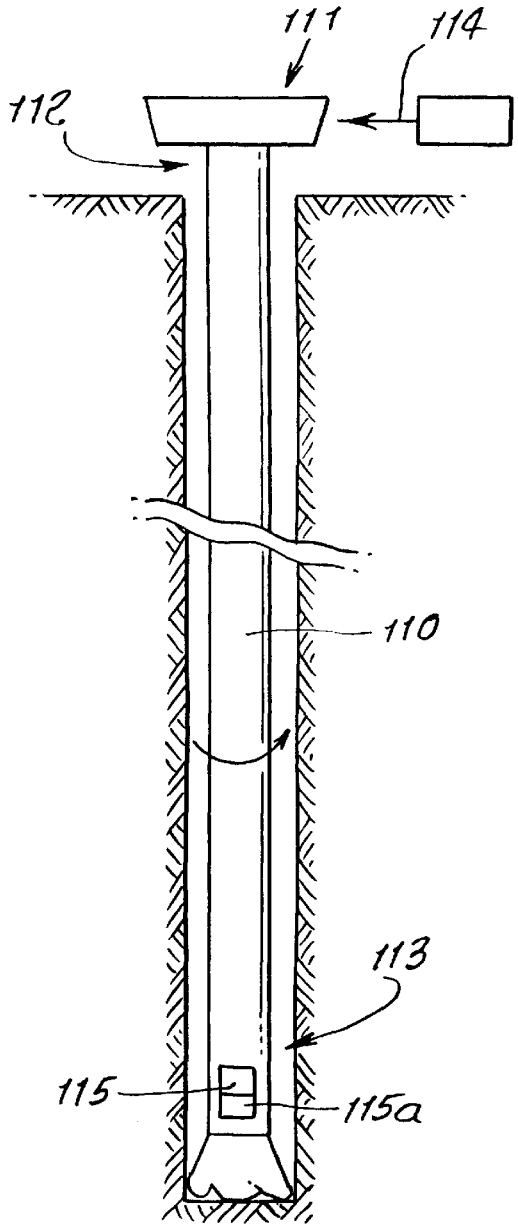
FIG. 4 is an elevation showing pipe string rotation.

FIG. 4 shows, in general form, the system as follows:

i) a pipe string 110, ii) means 111 for effecting displacement (for example rotation) of the pipe string, at upper zone 112, and in a manner to effect a corresponding pipe displacement at a lower zone 113, iii) such displacement of the pipe including modulation input at 114 representing at least two levels (for example 1 and 0) of a coded sequence of such alternate levels, the sequence containing a message to be transmitted to the lower zone.

Circuitry 115 (for example an accelerometer) at the lower zone detects such corresponding pipe displacement, for processing and use at 115*a* as in FIG. 3.

Figure 5:
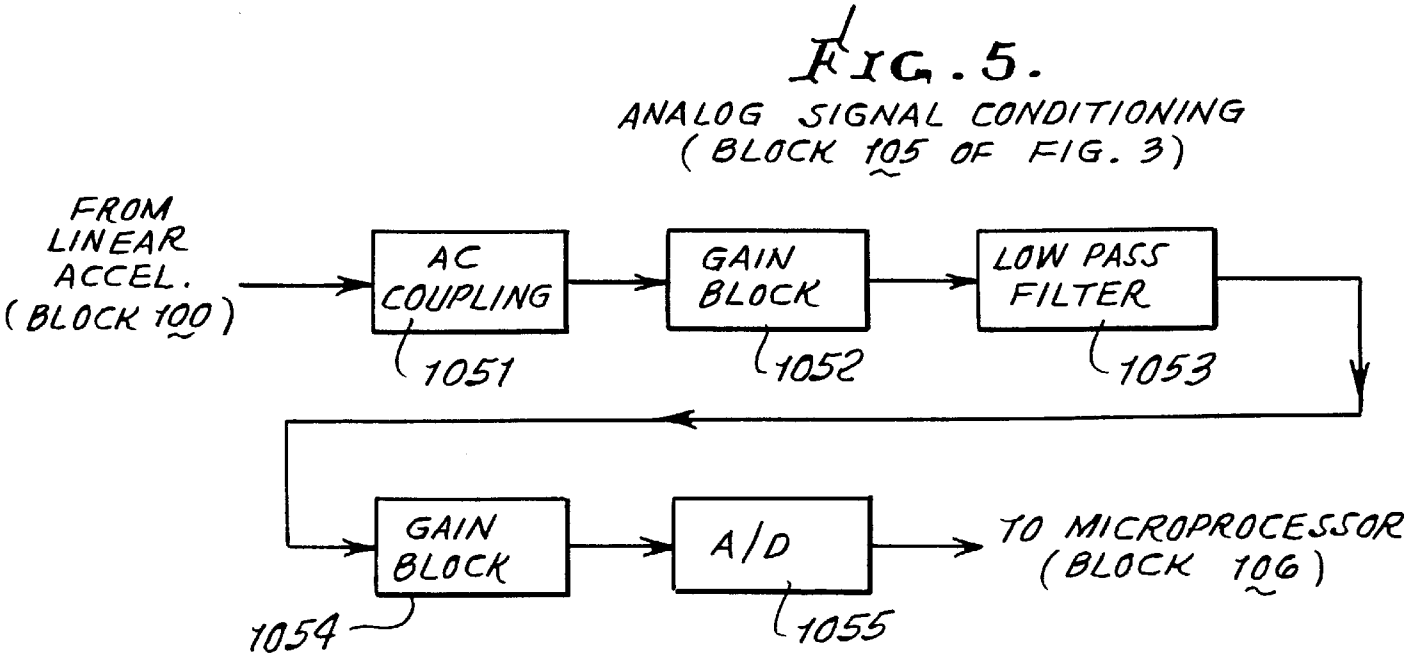
FIGS. 5–9 are block diagrams, labeled as shown.
Figure 6:
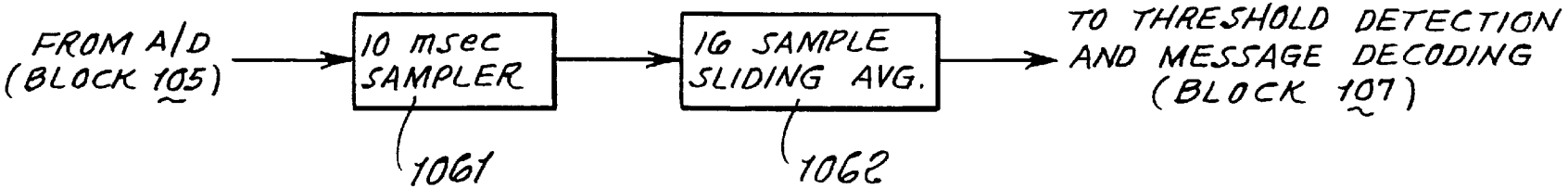

Reference is next made to analog signal conditioning of flow accelerometer output (FIG. 5). The output of the linear accelerometer (block 100 of FIG. 3) is first passed through a high pass filter or AC coupler (block 1051). This filter increases sensitivity to vibration and substantially completely removes sensitivity to all other types of inputs. The signal is then amplified (block 1052) and passed through a low pass filter (block 1053) which removes any high frequency noise from the signal. The signal then passes through another amplification stage (block 1054) and into the analog to digital converter (block 1055). As seen in FIG. 6, the flow detect accelerometer output is typically sampled at a rate of 100 Hz (block 1061) and the sampled signal is passed through a non-weighted 16 sample sliding average (block 1062). This filtered read out is used in all of the talkdown processing.

Figure 7:
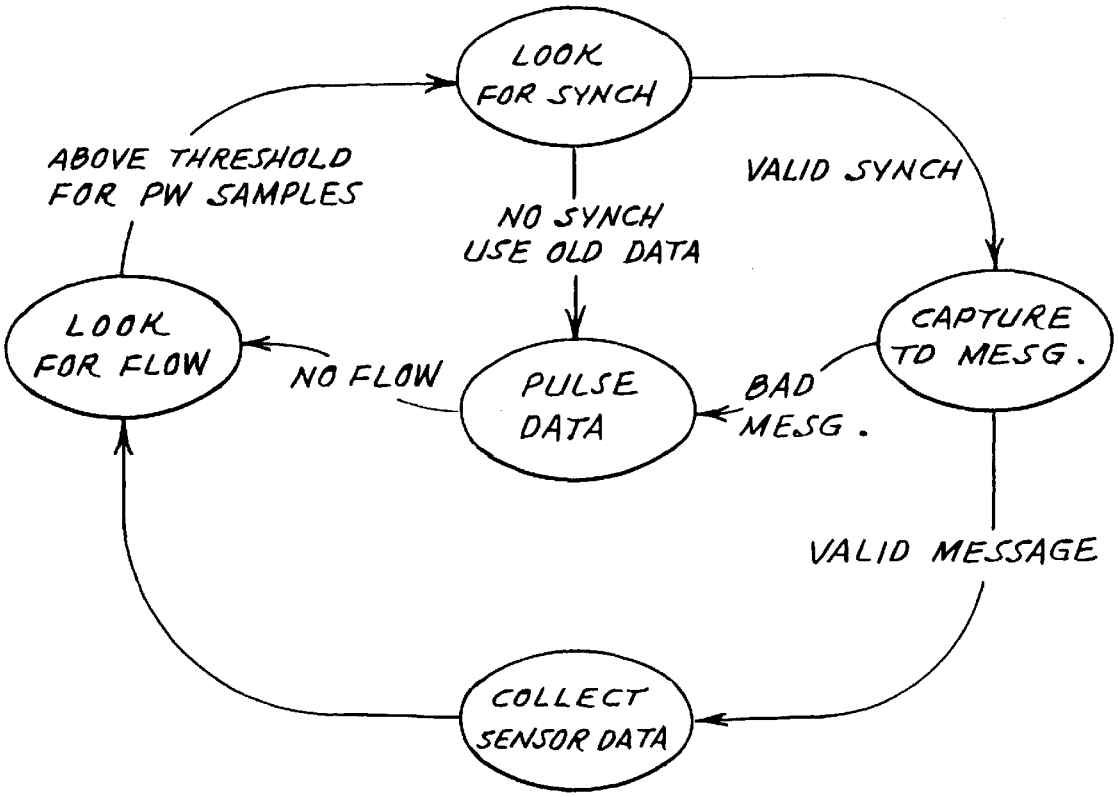

Referring to FIG. 7, after the filtered accelerometer output at 80 has been detected to be continuously above a user selectable threshold for more than a pulse width minus the tolerance (4 seconds), the system looks for the completion of a talkdown message synch, which corresponds to the first pulse and the rising edge of the second pulse. Edge detection is accomplished by means of a time hysteresis edge detector, as per block 107*al* in FIG. 8, with a hysteresis time of 0.5 sec. The timing between the first and second rising edges determines the validity of the synch. These rising edges must be 2 pulse widths apart with a tolerance of +/−4 seconds. The time between edges is measured via the edge timer of block 107*a*2, and the time between edges compared against the tolerances with the time comparator of block 107*a*3.

Following the second rising edge of the message, there will be at least one full pulse width during which the signal is high. The output of block 1062 in FIG. 6 is sampled once per second during this phase (block 107*bl*, FIG. 9). For each sample, a 1 or a 0 will be stored in the pulse pattern buffer of block 107*b*3 corresponding to a reading above or below the threshold, as determined by the threshold comparator of block 107*b*2 whose threshold is specified by the operator.

Figure 9:
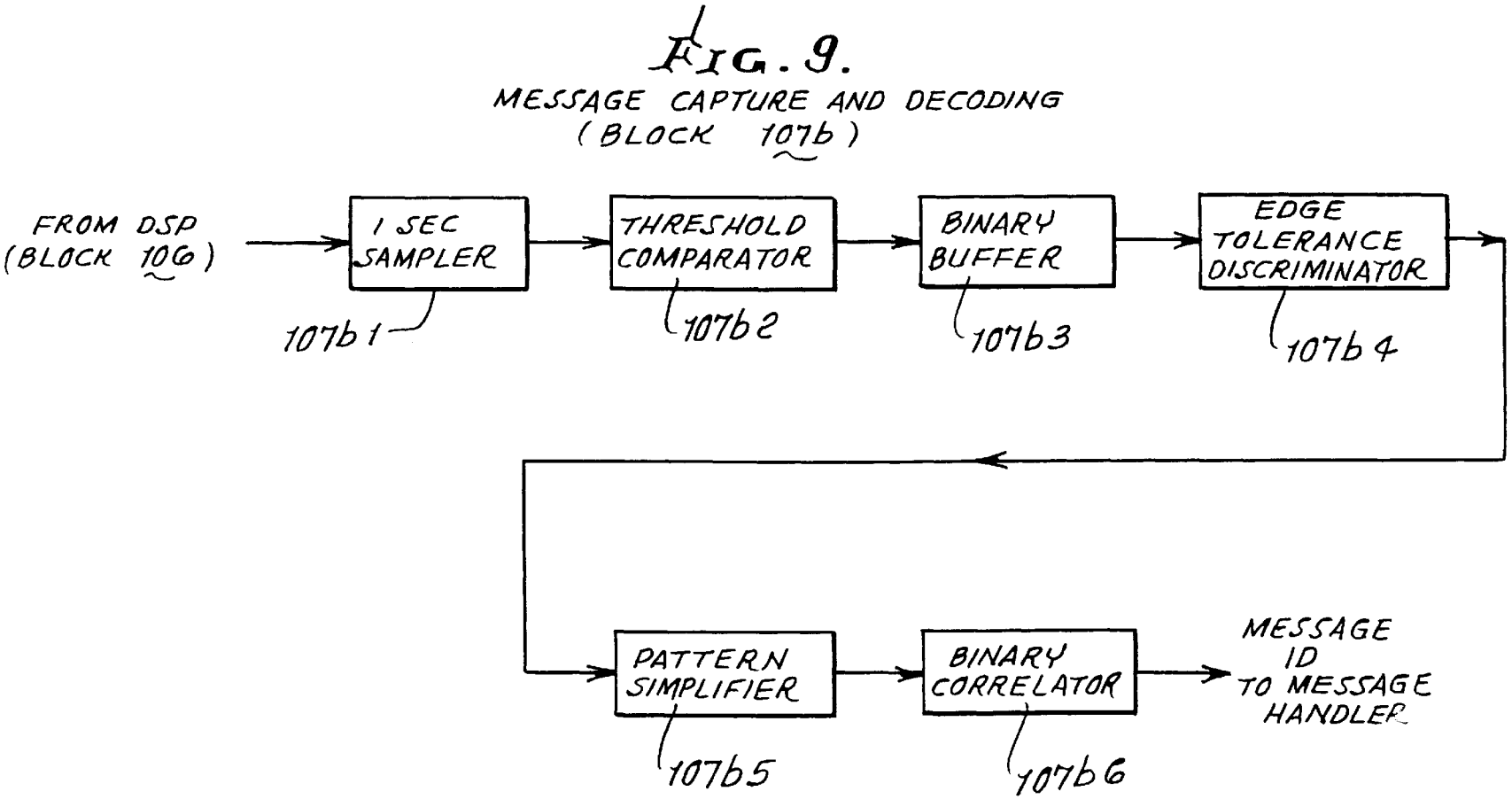

The edge tolerance discriminator, block 107*b*4, FIG. 9, determines whether or not the timing between rising edges of the message fall within specification. Each rising edge must be a multiple of the pulse width from the second synch rising edge +/− a 4 second tolerance. If any of the message edges do not meet this tolerance, the edge tolerance discriminator will reject the message.

The pattern simplifier, block 107*b*5, simplifies the stored 1 sec sampled pulse pattern into a 1 binary digit per pulse width representation. The area of each pulse width worth of samples is calculated and compared with 70% of the unit height nominal pulse width area. If this is met, the simplified pulse pattern buffer slot corresponding to the appropriate pulse width time is filled with a 1, otherwise a 0 will be stored. This simplified pattern buffer is passed to the binary correlator, block 107*b*6, FIG. 9. The binary correlator, conducts a simple byte compare between the simplified received pattern and the known talkdown message patterns. If a match occurs, the message ID is passed to the talkdown message handling system, otherwise an error is returned. In the event of an error, the controller will pulse data from the last message, once flow is detected (assuming it is not another talkdown attempt).

The falling edge must simply be quick enough so that the next pulse width time is not 70% of the pulse width. Therefore, with a pulse width of 20 seconds, a falling edge must pass below the threshold before 14 seconds into the next pulse width time.

Figure 11:
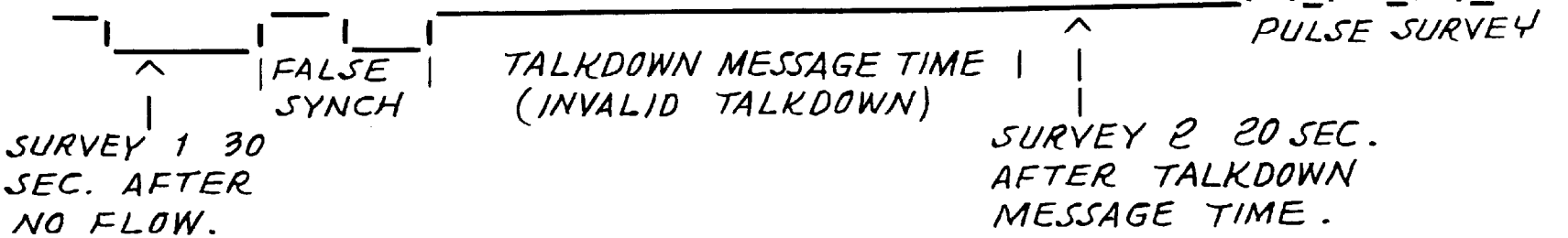
FIG. 11 is a survey reading status diagram.

Survey Reading (See FIG. 11)

The survey is taken 20 seconds after the talkdown message time. The completion of a talkdown message is always 7 pulse widths after the first rising edge of the synch, regardless of the talkdown message sent (even if the last pulse of the message was sooner). This survey will be pulsed up 1 minute from the start of flow. FIG. 11 shows when surveys are sampled and which survey data will be sent when flow begins. In the event of a false talkdown synch, Survey I will be sent. Otherwise, Survey 2 will be sent.

Talkdown Message Strings (Tool Response to Talkdown Message)

For Mud-Pulse use, the first talkdown message toggles the pulse-width used for tool-to-surface communications. The remaining messages are operator defined. A talkdown message other than the pre-defined message will typically cause the tool to send the last survey collected and begin processing an operator-defined message string. Each message string consists of a continuous and a periodic portion. Each of these sub-sections defines a list of data items to be sent. The periodic section will also list a rate at which to repeat the periodic message. In the case of the continuous part, the data items are sent one after the other, continuously. When the end of the string is reached, the tool will again operate in correspondence to the first item in the message string. The periodic portion of the message will interrupt the continuous message at the specified rate. All items in the periodic message will be sent once, after which the interrupted continuous message will resume.

Figure 10:
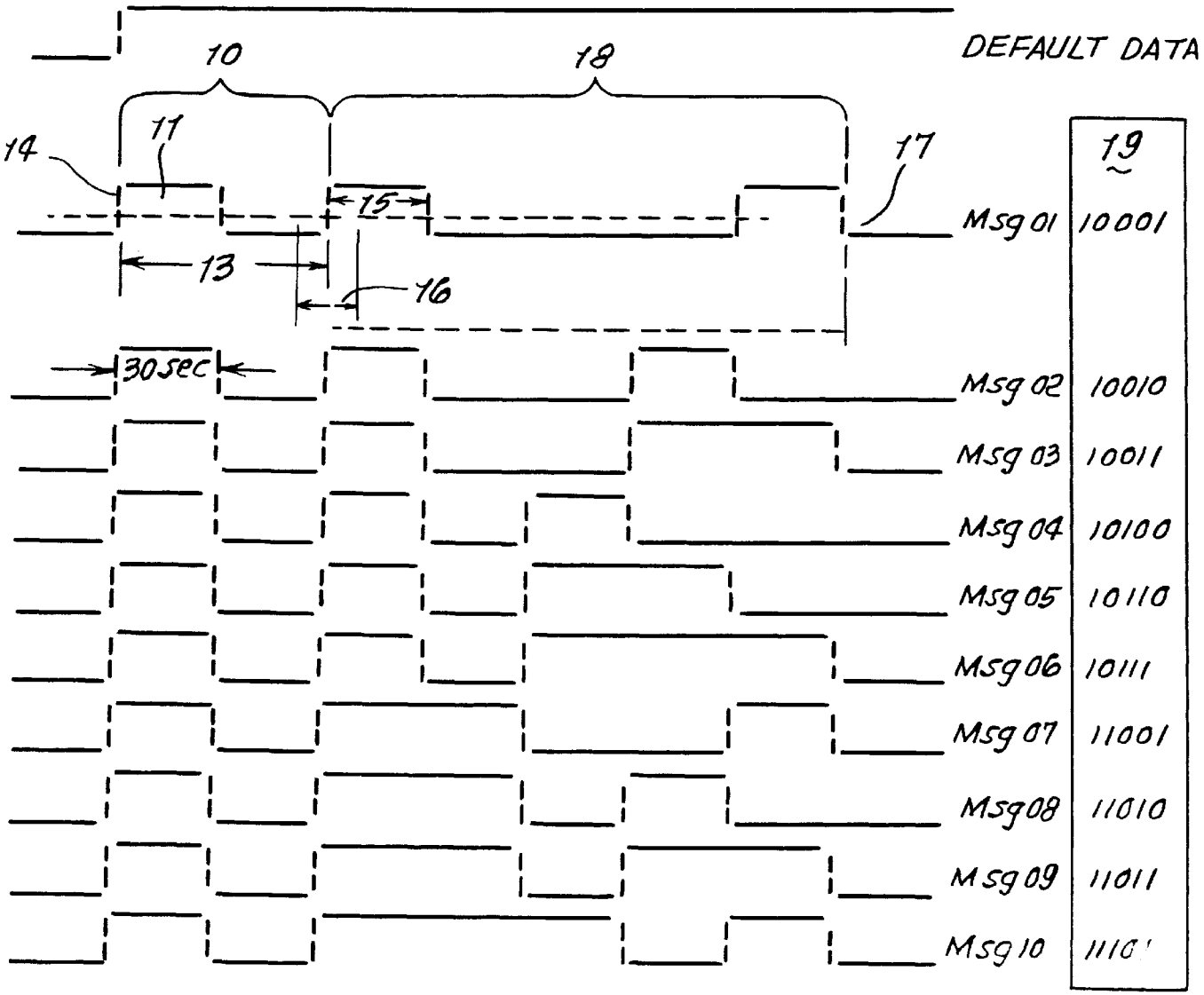
FIG. 10 is an expanded waveform diagram.

Example of Talkdown Signal Coding, see FIG. 10.

It will be observed that:

- Each waveform has exactly three rising edges.
  - More would likely be too error prone for human controlled signaling.
  - Fewer edges increases the odds of erroneously encoding a message while tripping.
- Every waveform begins with a synch which is 1 pulsewidth ON, 1 pulsewidth OFF, followed by a rising edge for a pulse of any width.
  - Simplifies detection of a talkdown message.
  - Decreases amount of time necessary to determine that noise is not a talkdown message.
- Every pulse begins a multiple of pulsewidths from the first rising edge of the message.
  - Sub-pulsewidth positioning would likely be too difficult for human controlled signaling.
- There is at least a pulsewidth sized OFF time after every pulse.
  - Sub-pulsewidth off times would make use of mud flow for talkdown unreliable.
- Every message ends with a falling edge (to avoid ambiguity between end of message and start of flow)
- Every message is exactly 7 pulsewidths in duration.

The pulsewidth for these waveforms is defined at the top of the talkdown table file. The range for the talkdown pulse width is 10 to 40 seconds.

Talkdown message timing is relative to the first rising edge. Each rising edge after the first must occur as specified +/−4 seconds from the first rising edge.

Several applications may require something more than a change in the data string sent from the tool. Applications such as GyroMWD (gyro-controlled "measure while drilling") require a sequence of commands to be executed in addition to modifying the data sent by the tool. In talkdown implementations described above, tool commands are only supported through pre-defined messages, such as the toggle pulse width command used in Mud-Pulse control. It may, however, be useful for the command sequence to be configurable. For this reason, downhole processing of talkdown messages is caused to support such command sequencing as by surface software. Commands may be embedded in the message string so that a particular action will be carried out by the tool every time in response to reception of the message string. The periodic portion of the message string also supports embedded commands.

The looping mechanism of FIG. 7 has been further expanded to allow looping back to any point in the message string. This allows the operator to define a portion of the message string as a one-time occurrence.

More specifically as a preferred embodiment, and with respect to FIGS. 7–11, please note the following:

Threshold Detection and Message Capture State Machine (FIG. 7)

FIG. 7 is a state diagram showing the possible states in processing a message and the transitions between them.

Initially, the tool will be looking for flow, which excites the linear accelerometer in the same manner as drill pipe rotation. If the filtered accelerometer output is found to be above an operator selectable threshold (17 in FIG. 1) for a time period equal to the pulsewidth (15 in FIG. 1) the tool will begin looking for a synch. If a synch (10 in FIG. 1) is detected, the tool will begin storing the message waveform, otherwise previously collected data will be sent. If the synch was detected and a valid message was decoded, the data corresponding to that message will be sent. If the message is determined to be invalid, previously collected data will be sent.

Figure 1:
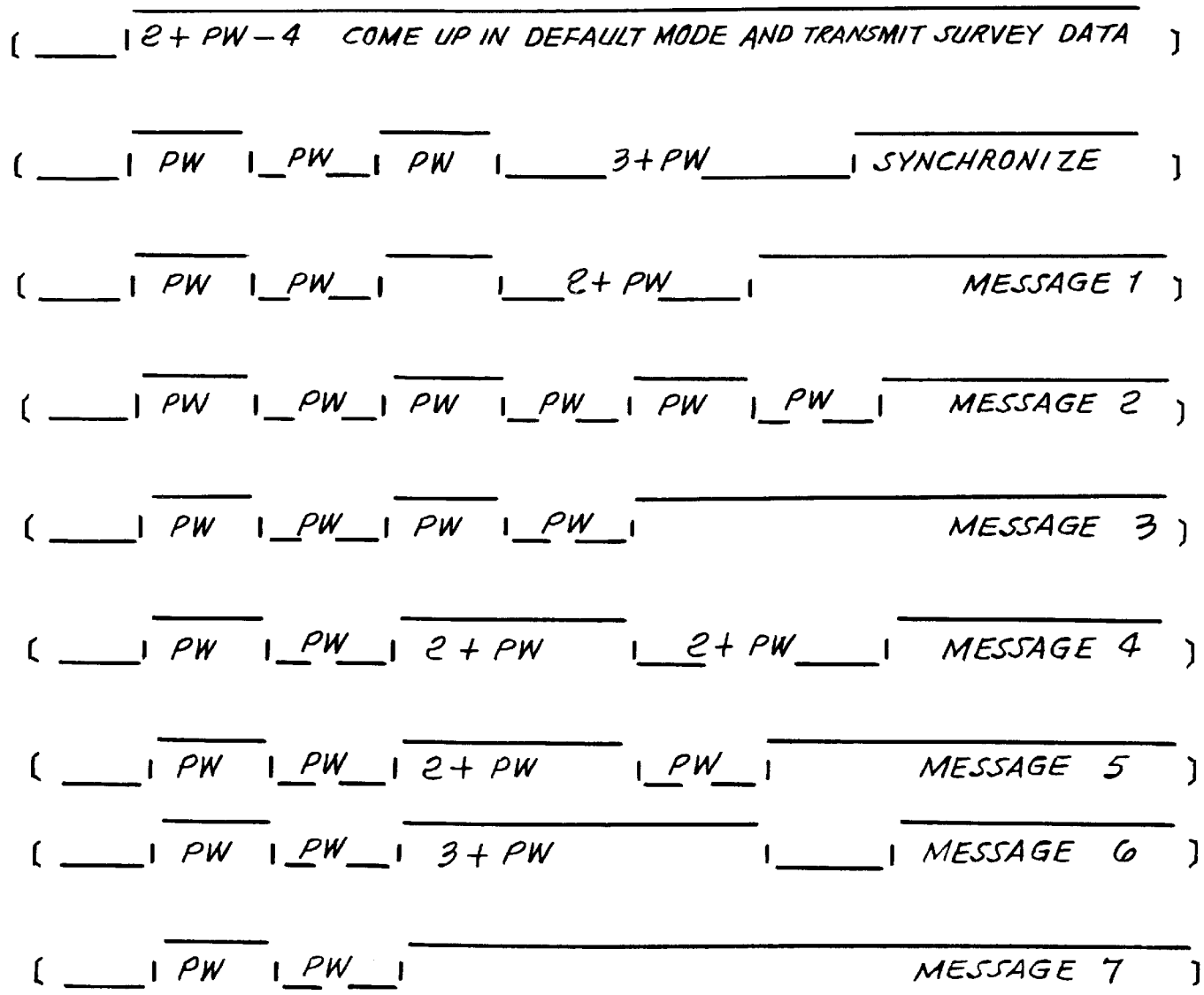
FIG. 1 is a waveform diagram showing typical time relation signals for message transmission.

Synch Timing (FIG. 1)

FIG. 1 is a waveform diagram of the various messages. Message #1 (labeled Msg 1) is used to describe the synch and message timing in detail. The synch 10, corresponds to the first pulse 11 and the rising edge 12 of the second pulse. The timing 13 between the first rising edge 14 and second rising edge determines the validity of the synch and must be two pulse widths with a tolerance 16 of +/− four seconds. The pulse width 15 is set by the operator, and can be from ten to forty seconds. The message portion 18 of the waveform corresponds to the portion following the synch. Column 19 indicates the equivalent binary representation of the corresponding message.

Figure 8:
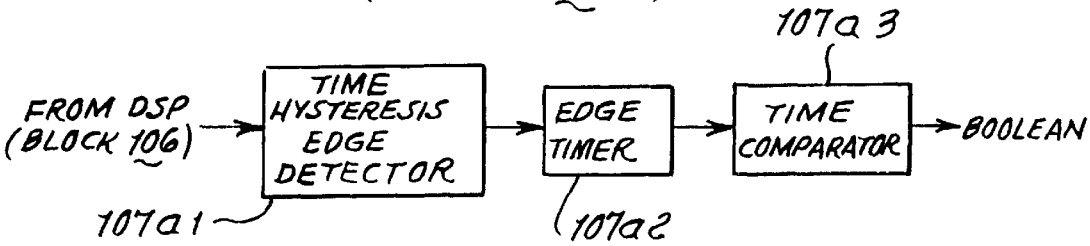

Synch Signal Processing (FIG. 8)

FIG. 8 shows a block diagram of the signal processing performed during synch decoding. Edge detection is accomplished by means of a time hysteresis edge detector as per block 107*a*1 in FIG. 8, with a hysteresis time of 0.5 seconds. The time between the first and second rising edges is measured via the edge timer of block 107*a*2 and compared against the tolerance with the time comparator of block 107*a*3. If the time between these edges, as previously mentioned, is two pulse widths +/− the tolerance, message decoding will begin.

Message Decoding (FIG. 9)

The output of block 1062 in FIG. 6 is sampled once per second, per block 107*b*1 of FIG. 9 during the capture message state (see FIG. 7 for message capture state machine). Each sample value will be compared with the operator selected threshold (16 in FIG. 1) by a threshold comparator, block 107*b*2, which will output a 1 for a value above the threshold and a 0 otherwise. These 1's and 0's will be stored in a binary buffer, block 107*b*3.

The edge tolerance discriminator, block 107*b*4, FIG. 9, determines whether or not the timing between rising edges of the message fall within specification. Each rising edge must be a multiple of the pulse width from the first synch rising edge (13 of FIG. 1) +/− the tolerance (15 of FIG. 1). If any of the message edges do not meet this tolerance, the edge tolerance discriminator will reject the message.

The pattern simplifier, block 107*b*5, simplifies the stored 1 sec sampled pulse pattern into a 1 binary digit per pulse width representation. The area of each pulse width worth of samples is calculated and compared with 70% of the unit height nominal pulse width area. If this is met, the simplified pulse pattern buffer slot corresponding to the appropriate pulse width time will be filled with a 1, otherwise a 0 will be stored. This simplified pattern buffer is passed to the binary correlator, block 107*b*6, FIG. 9.

The binary correlator, block 107*b*6, FIG. 9, conducts a simple byte compare between the simplified received pattern and the known talkdown message patterns. If a match occurs, the message ID is passed to the talkdown message handling system, otherwise an error is returned. In the event of an error, the controller will pulse data from the last message once flow is detected (assuming it is not another talkdown attempt).

The falling edge must simply be quick enough so that the next pulse width time is not 70% of the pulse width. Therefore, with a pulse width of 20 seconds, a falling edge must pass below the threshold before 14 seconds into the next pulse width time.

107*b*7 depicts typical content of the binary buffer when the pulse width is set to 10 seconds and the transmitted message is #5 (see FIG. 1 for Msg 5 waveform). There are 10 binary digits in the 107*b*7 per pulse width. The synch portion of the waveform is not stored in this buffer. The data in 107*b*7 is shown imperfect so that the effects of the pattern simplifier can be seen. The output of the pattern simplifier 107*b*8 for this case exactly matches the binary representation of message number 5 (see FIG. 1), and will be detected by the binary correlator as such.

Another aspect of the invention includes also rotating the pipe string in the borehole while effecting said imparting according to sub-paragraph a) of claim 1. That aspect may also include effecting drilling of a sub-surface formation in response to said rotating of the pipe string. Such levels may correspond to different levels of pipe angular velocity.

The invention also includes the method of transmitting a coded message via a pipe string in a borehole, that includes a) imparting to a first portion of the pipe string a sequence of pulses representing the coded message, b) and detecting said pulses at a second portion of the pipe string spaced lengthwise of said first portion, said pulses being in the form of rotary displacements of the pipe string.

Such pulses are typically in the forms of different level displacements; and such displacement levels correspond to different levels of pipe angular velocity.

Apparatus, devices, method steps, and modes of operation as defined in the following claims are incorporated into the present specification, by reference.

We claim:

1. A method for downward communication in a borehole containing a pipe string, comprising the steps of:

a) imparting a series of rotary motions to an upper portion of the string, said rotary motions representing at least two levels of a coded data sequence, said rotary motions imparted to said string upper portion effecting generally comparable motions at a string lower portion, b) said motions at the string lower portion effecting a downhole detectable condition or conditions indicative of said imparted rotary motions, c) detecting said condition or conditions to determine a corresponding coded data sequence, d) and processing said corresponding data sequence to recover the imparted coded data sequence, from which a unique transmitted message is determinable, e) said detecting including providing and operating means to detect said downhole condition or conditions, there being an accelerometer having an output which is filtered and amplified.

2. The method of claim 1 in which the downhole condition is a linear vibration.

3. The method of claim 1 in which the downhole condition is angular vibration.

4. The method of claim 1 in which the downhole condition is an inertial angular rate.

5. The method of claim 1 wherein an a linear accelerometer is provided, and wherein the downhole condition is detected by said linear accelerometer.

6. The method of claim 1 wherein an angular accelerometer is provided, and wherein the downhole condition is detected by said angular accelerometer.

7. The method of claim 1 wherein an angular rate sensor is provided, and wherein the downhole condition is detected by said angular rate sensor.

8. The method of claim 1 in which two or more of said downhole conditions are effected, and are detected, to provide increased reliability in the determination of the transmitted message.

9. The method of claim 1 including also rotating the pipe string in the borehole while effecting said imparting according to sub-paragraph a) of claim 1.

10. The method of claim 9 including effecting drilling of a sub-surface formation in response to said rotating of the pipe string.

11. The method of claim 1 wherein said levels correspond to different levels of pipe angular velocity.

12. A method for downward communication in a borehole containing a pipe string, comprising the steps of:

a) imparting a series of rotary motions to an upper portion of the string, said rotary motions representing at least two levels of a coded data sequence, said rotary motions imparted to said string upper portion effecting generally comparable motions at a string lower portion, b) said motions at the string lower portion effecting a downhole detectable condition or conditions indicative of said imparted rotary motions, c) detecting said condition or conditions to determine a corresponding coded data sequence, d) and processing said corresponding data sequence to recover the imparted coded data sequence, from which a unique transmitted message is determinable, e) said condition or conditions comprising one or more parameters related to inertial rotary motion, f) said detecting including detecting acceleration of said string lower portion, producing an output in response to said detecting, and filtering and amplifying said output.

13. The method of claim 12 including at least one of the following:

i) providing an angular acceleration sensor ii) providing a rate-of-change of angular acceleration sensor iii) providing an inertial angular rate sensor and operating said sensor downhole in the borehole to detect said condition or conditions.

14. The method for transmitting a message between upper and lower zones of a pipe string in a borehole, that includes the steps a) effecting rotary displacement of the pipe string at said upper zone in a manner to effect a corresponding pipe rotary displacement at said lower zone, b) said displacement representing at least two levels of a coded data sequence containing said message, c) and detecting said displacement including acceleration at said lower zone to produce output which is subjected to filtering and amplifying.

15. The method of claim 14 including providing a sensor in the borehole, and operating said sensor to provide said detecting of said corresponding pipe displacement, at said lower zone.

16. The method of claim 14 wherein said displacement of the pipe string at said upper zone is a rotary displacement that is repeatedly varied.

17. The method of claim 16 wherein said rotary displacement is transmitted via varied torsion exertion on the pipe string, between said upper and lower levels.

18. The method of claim 15 wherein said sensor is provided to be one or more of the following:

i) a linear motion accelerometer ii) an angular motion accelerometer iii) an angular rate sensor iv) a rate-of-change angular accelerometer sensor.

19. The method of claim 14 wherein said upper zone is at or proximate the upper end of the pipe string.

20. The method of claim 19 wherein a rotary table is provided at or near the upper end of the pipe string which is a drill pipe string, and said a) step is effected via displacement of the rotary table.

21. The method of claim 14 wherein said lower zone is at or proximate a drill bit driven by rotation of the pipe string.

22. The method of claim 14 wherein said rotary displacement is effective by transmitting pulses to the pipe string, said pulses having widths in excess of about 15 seconds.

23. The method for transmitting a message between upper and lower zones of a pipe string in a borehole, that include the steps a) effecting rotary displacement of the pipe string at said upper zone in a manner to effect a corresponding pipe rotary displacement at said lower zone, b) said displacement representing at least two levels of a coded data sequence containing said message, c) detecting said corresponding pipe displacement at said lower zone by providing a sensor in the borehole, and operating said sensor to provide said detecting of said corresponding pipe displacement, at said lower zone, d) and wherein said sensor includes an accelerometer detecting vibrational acceleration of pipe string due to rotation, and having an output, there being a sampler means responsive to the accelerometer output to sample at time intervals in excess of 50 times per second, there also being a filter to filter and average the output of the sampler, and including the step of determining from the output of the filter whether pipe string rotation is occurring, and if such rotation is determined as occurring then monitoring an output device from the output of the accelerometer to detect transitions above and below a threshold, for message determination.

24. The method of claim 23 wherein a downhole tool is provided, and including operating said tool in response to said message determination.

25. A method for downward communication in a borehole containing a pipe string, comprising the steps of:

a) imparting a series of rotary motions to an upper portion of the string, said rotary motions representing at least two levels of a coded data sequence, said rotary motions imparted to said string upper portion effecting generally comparable motions at a string lower portion, b) said motions at the string lower portions effecting a downhole detectable condition or conditions indicative of said imparted rotary motions, c) detecting said condition or conditions to determine a corresponding coded data sequence, d) and processing said corresponding data sequence to recover the imparted coded data sequence, from which a unique transmitted message is determinable, e) and wherein said detecting includes providing and operating an accelerometer to detect said downhole condition or conditions, the accelerometer having an output, and said processing includes filtering and amplifying said output.

26. The method of claim 25 which includes digitizing the filtered and amplified output of the accelerometer, to produce a digitized output.

27. The method of claim 26 including repeatedly sampling said digitized output to produce a further output, and then subjecting said further output to progressive averaging to produce a progressively averaged output in the form of pulses.

28. The method of claim 27 including monitoring said progressively averaged output to determine whether it is continuously above a selected threshold for a predetermined time period, in which event, perspective message pulses are determined as being transmitted.

29. The method of claim 28 including subjecting said prospective message pulses to pulse edge and pulse width discrimination, as a further determination of message validity.

30. A method for downward communication in a borehole containing a pipe string, comprising the steps of:

a) imparting a series of rotary motions to an upper portion of the string, said rotary motions representing at least two levels of a coded data sequence, said rotary motions imparted to said string upper portion effecting generally comparable motions at a string lower portion, b) said motions at the string lower portion effecting a downhole detectable condition or conditions indicative of said imparted rotary motions, c) detecting said condition or conditions to determine a corresponding coded data sequence, said detecting including providing and operating means to detect said downhole condition or conditions, there being an accelerometer having an output which is filtered and amplified, d) and processing said corresponding data sequence to recover the imparted coded data sequence, from which a unique transmitted message is determinable, e) said condition or conditions comprising one or more parameters related to inertial rotary motion, f) and wherein said rotary motions correspond to talk-down signal coding pulse waveforms, characterized by provision of one or more of the following:

i) each waveform has exactly three rising edges, ii) every waveform begins with a synch which is 1 pulsewidth ON, 1 pulsewidth OFF, followed by a rising edge for a pulse of any width, iii) every pulse begins a multiple of pulsewidths from the first rising edge of the message, iv) there is at least a pulsewidth sized OFF time after every pulse, v) every message ends with a falling edge, vi) every message is exactly 7 pulsewidths in duration.

31. The method of transmitting a coded message via a pipe string in a borehole, that includes a) imparting to a first portion of the pipe string a sequence of pulses representing the coded message, b) and detecting said pulses at a second portion of the pipe string spaced lengthwise of said first portion, said pulses being in the form of rotary displacements of the pipe string, c) said detecting including detecting acceleration at said second portion of the pipe string to produce output which is subjected to processing including filtering and amplification.

32. The method of claim 31 wherein said pulses are in the form of different level displacements.

33. The method of claim 32 wherein said displacement levels correspond to different levels of pipe angular velocity.

* * * * *